US005634715A

United States Patent [19]

Stehr et al.

[11] Patent Number: 5,634,715

[45] Date of Patent: Jun. 3, 1997

[54] INSTALLATION FOR THE MIXING OF LIQUID AND SOLID MATTER

[75] Inventors: Norbert Stehr, Grünstadt; Dieter März, Mannheim, both of Germany

[73] Assignee: Draiswerke GmbH, Mannheim, Germany

[21] Appl. No.: 608,002

[22] Filed: Mar. 4, 1996

[30] Foreign Application Priority Data

Mar. 3, 1995 [DE] Germany ..... 195 07 366.5

[51] Int. Cl.[6] ..... B01F 15/02

[52] U.S. Cl. ..... 366/137; 366/152.1; 366/159.1; 366/160.1

[58] Field of Search ..... 366/152.1, 152.2, 366/152.6, 153.1, 159.1, 160.1, 162.2, 167.1, 182.2, 131, 132, 136, 137

[56] References Cited

U.S. PATENT DOCUMENTS

| | | | |
|---|---|---|---|
| 3,741,533 | 6/1973 | Winn | 366/139 |
| 3,957,210 | 5/1976 | Durr . | |
| 4,394,980 | 7/1983 | Marz et al. . | |
| 4,475,818 | 10/1984 | Bialkoski | 366/152.1 |
| 4,863,277 | 9/1989 | Neal | 366/137 |
| 4,881,819 | 11/1989 | Blees | 366/152.2 |
| 5,103,908 | 4/1992 | Allen | 366/137 |

FOREIGN PATENT DOCUMENTS

| | | |
|---|---|---|
| 0154901 | 9/1985 | European Pat. Off. . |
| 2932459 | 2/1981 | Germany . |
| 2945361 | 5/1981 | Germany . |
| 3218637 | 11/1983 | Germany . |
| 92/21436 | 12/1992 | WIPO . |

OTHER PUBLICATIONS

SOFW Journal, "Cosmetics Detergents Specialities", pp. 2–4 (Apr. 1992).

*Primary Examiner*—Tony G. Soohoo

*Attorney, Agent, or Firm*—Browdy and Neimark

[57] ABSTRACT

An installation for the mixing of a given quantity of liquid with a given quantity of powdery solid matter comprises a storage tank for the liquid and a mixing device having an inlet hopper. A liquid supply conduit, coming from the storage tank, and a solid matter proportioning device open into the inlet hopper. The supply capacity of the proportioning device and the throughput of the mixer are adjustable in such a way that the given quantity of solid matter is added to the liquid by several circulations of the liquid through the mixer.

21 Claims, 2 Drawing Sheets

INSTALLATION FOR THE MIXING OF LIQUID AND SOLID MATTER

BACKGROUND OF THE INVENTION

1. Field of the Invention

The invention relates to an installation for the mixing of a given quantity of liquid with a given quantity of powdery solid matter.

2. Background Art

In practice, for instance in dyeing industry, there is the recurring problem of premixing, free from dust, a given quantity of liquid with a given quantity of powdery solid matter which tends to dust, such as a pigment. Subsequently, such mixes are as a rule ground and dispersed in agitator mills. When pigment is added to liquid, paint or lacquer will be produced in the subsequent agitator mill. In practice, the problem of the dustfree mixing of such solid matter and liquid has so far not been satisfactorily solved. Moreover, the simultaneous uniting of the entire charges, i.e. of the entire given quantity of liquid and the entire given quantity of powdery solid matter, will as a rule lead to strong agglomerations, rendering the ensuing grinding and dispersing process more difficult and complicated. In this application, the terms "liquid" and "solid matter" also imply the plural of each term.

A device for wetting and dispersing powdery solid matter in liquids is known from PCT WO 92/21436, having a disk-shaped rotor arranged in a dispersion chamber. Provision is made for a powdery solid matter inlet on one side of the disk-shaped rotor and for the liquid inlet on the other side of the disk-shaped rotor. The powdery solid matter and the liquid are united in a wetting chamber in a marginal zone of the rotor disk. A liquid/powder mix outlet is arranged at the outer edge of the wetting chamber which surrounds the rotor disk. The liquid and the powdery solid matter are supplied by suction by means of the high-speed driven rotor disk. The powdery solid matter can be sucked from a hopper disposed above the device and/or from a bag, storage tank or the like by way of a hose. Furthermore, the SOFW Journal entitled "Cosmetics Detergents Specialities", 2nd folder of April 1992, pages 2 through 4, teaches, in this known device, to connect the outlet of the device with the liquid storage tank so that the liquid is circulated through the device, the solid matter thus concentrating in the liquid. The suction of the powdery solid matter is comparatively difficult and depends on quite a few influencing variables, such as the flow behavior of the powdery solid matter.

SUMMARY OF THE INVENTION

It is the object of the invention to embody an installation of the generic type which can be operated in such a way that dusting on the one hand and strong agglomerations on the other are largely avoided.

According to the invention, this object is solved by a storage tank for the given quantity of liquid, by a mixing device having a mixing shaft to be driven by a mixer driving motor, by a liquid supply conduit connecting an inlet hopper of the mixing device with the storage tank, by a solid matter proportioning device opening into the inlet hopper, and by the adjustability of the supply capacity of the solid matter proportioning device and of the throughput of the mixing device in such a way that the given quantity of solid matter is added to the given quantity of liquid by several circulations of the liquid through the mixing device. The gist of the invention resides in that a charge of powdery solid matter which tends to dust and a charge of liquid are united quasi-continuously in such a way that the liquid will circulate several times, even many times, the solid matter being concentrated in the liquid in the course of the high number of circulations. The solid matter delivery is proportioned, i.e. forced. The unification of solid matter and liquid takes place in the inlet hopper, premixing taking place right there. This helps avoid strong agglomerations. The kind of delivery of the solid matter precludes dusting.

Details of the invention will become apparent from the ensuing description of two exemplary embodiments, taken in conjunction with the drawing.

DESCRIPTION OF THE PREFERRED EMBODIMENTS

Figure 1:
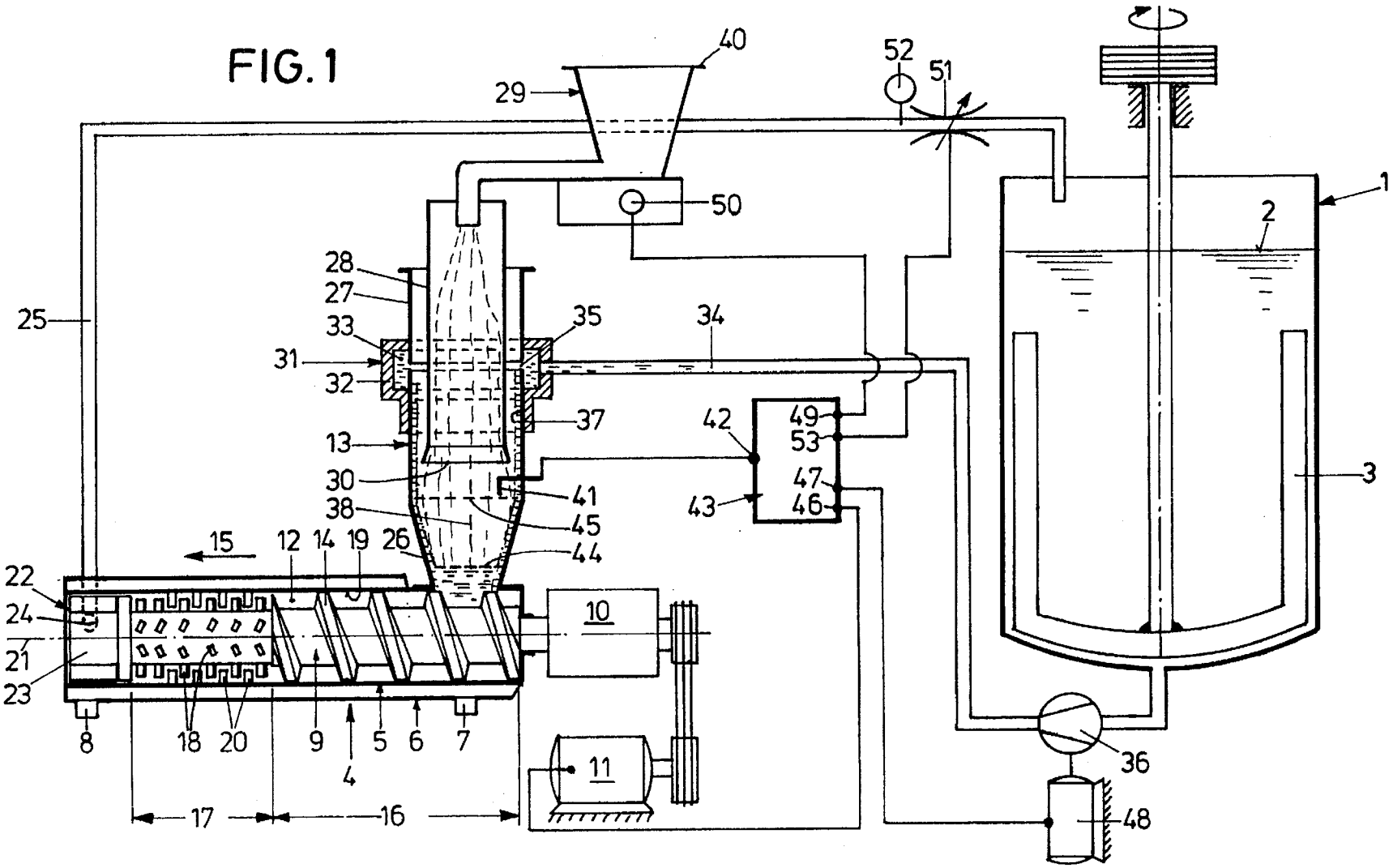
FIG. 1 shows an installation for mixing liquid and solid matter comprising a storage tank, a separate mixing device, and an inlet hopper with a proportioning device.

As shown in FIG. 1, the installation illustrated in the drawing comprises a storage tank 1, which has a volume sufficient for taking a given quantity of liquid 2. An agitator unit 3 drivable by a drive (not shown) is arranged in the storage tank 1.

Further, provision is made for a screw mixer 4, the substantially cylindrical casing 5 of which is surrounded by a heating jacket 6 having an inlet 7 and an outlet 8 for a temperature control medium for heating or cooling purposes. The casing 5 houses a mixing shaft 9 to be driven via an upstream transmission 10 by a mixer driving motor 11.

At one end of the housing 5, an inlet hopper 13 opens into the interior chamber 12 of the housing 5. In the vicinity of the inlet hopper 13 and over a substantial part of the casing 5, the mixing shaft 9 is a screw shaft with a helically encircling land 14. This is where the casing 5 may be provided with a so-called clearing gear, which meshes with the lands 14 for the regular transport of the substances to be mixed in the conveying direction 15 through the interior chamber 12. Clearing gears of this kind are known for instance from U.S. Pat. No. 3 957 210. Instead of a single screw machine with a clearing gear, the screw mixer 4 may also be a two-shaft screw machine of forced delivery by its nature.

The screw portion 16, provided with a land 14, of the mixing shaft 9 is followed by a portion of intimate mixing 17, in which the mixing shaft 9 is fitted with short pin- or strip-type mixing tools 18, with which are associated counterpart tools 20 fixed on the inside wall 19 of the casing 5. The mixing tools 18 and the counterpart tools 20 are disposed on alternating circles around the central axis 21 of the mixing shaft 9. The less the distance of the mixing tools 18 from counterpart tools 20 neighboring in the direction of the central axis 21, the higher the dispersing effect.

At the rear end of the casing 5 seen in the conveying direction 15, a return conveyor 22 is provided, comprising a pump impeller 23 which is mounted on the end of the mixing shaft 9 and which conveys the liquid 2 into an outlet passage 24 tangentially discharging from the casing 5. The outlet passage 24 is connected with the storage tank 1 via a return conduit 25. Of course, no return conveyor has to be provided when the mixing machine 4 is disposed directly above the storage tank 1.

The inlet hopper 13 comprises a lower hopper-type section 26, which is flanged on the casing 5, opens into the latter's interior chamber 12 and expands upwards, and an upper, approximately cylindrical section 27. A solid matter supply pipe 28 projects concentrically from above into the upper cylindrical section 27 of the inlet hopper 13, pourable powdery solid matter being fed from at least one solid matter proportioning device 29 into the solid matter supply pipe 28. This solid matter passes from a lower outlet 30 of the supply pipe 28 into the hopper-type section 26 of the inlet hopper 13. Slightly above this lower outlet 30, a closed circular pipeline 31 is provided, which is formed by an annular jacket 32 approximately C-shaped in cross-section and encircling the cylindrical section 27 of the inlet hopper 13. The annular chamber 33, thus defined, of the closed circular pipeline 31 is connected to a liquid supply conduit 34 which leads to the storage tank 1. At least one liquid passage hole 35, for instance in the form of an adjustable gap, is formed in the wall of the cylindrical section 27 of the inlet hopper 13. Liquid 2 supplied by a pump 36 from the storage tank 1 through the supply conduit 34 flows from the annular chamber 33 right through the passages holes 35 into the cylindrical section 27 of the inlet hopper 13. It flows down on the inside wall 37 of the cylindrical section 27 into the hopper-type section 26. The solid matter 38 flowing downwards is entirely enveloped by the liquid 2 on the inside wall 37, the supply of the liquid 2 to the mixer 4 taking place by gravity feed in the inlet hopper 13. It equally serves as a medium of transportation for the gravity-fed solid matter 38, a certain premixing of liquid 2 and solid matter 38 taking place in the inlet hopper 13. This design of an inlet hopper 13 for the supply of solid matter and liquid to a treating machine is known per se from U.S. Pat. No. 4 394 980.

The solid matter proportioning device 29 has a hopper 40, which either has a volume sufficient to take the entire charge of solid matter 38 or to which the given quantity of solid matter is continuously supplied during a complete mixing cycle. No especially high demands are made on the proportioning accuracy of the solid matter proportioning device 29. The proportioning device only has to be adjustable in such a way that it will deliver the given quantity of powdery solid matter to the inlet hopper 13 over a given time interval. The proportioning device 29 can have a volumetrically conveying screw or a gravimetrically conveying screw or a gravimetrically conveying belt conveyor. The simplest yet sufficient design provides for a volumetrically conveying screw. Proportioning devices of this type are known and commercial. Fundamentally, it is even sufficient if it is possible to set a desired value for the solid matter volume to be delivered per unit of time.

If the aspiration of air is to be avoided reliably during the addition of solid matter 38 and liquid 2 into the mixer 4, then the screw mixer 4 must always be filled completely. To this end, a level measuring device having a non-contact level measuring probe 41 is disposed in the hoppers type section 26 of the inlet hopper 13. This probe 41 continuously emits level measuring signals to an input 42 of a control unit 43. In the control unit 43, these signals are processed in such a way that a control signal corresponding to a minimum level 44 and to a maximum level 45 is produced, which is delivered to the driving motor 11 of the mixing shaft 9 and/or a pump driving motor 48 via outputs 46, 47 for alternative or cumulative triggering. When the probe 41 signals a deviation below the minimum level 44, then the speed of the mixing shaft 9 and thus the throughput of the mixer 4 is decreased or the speed of the driving motor 48 of the pump 36 and thus the latter's pump capacity is increased by the driving motor being triggered. When, however, the probe 41 signals a deviation above the maximum level 45 in the inlet hopper 13, then either the speed of the driving motor 11, and thus the throughput of the mixer 4, is increased or the speed of the driving motor 48 of the pump 36 and thus the supply of liquid is decreased. Both measures may also be taken simultaneously. Fundamentally, it is also possible to trigger the drive 50 of the solid matter proportioning device 29 via an output 49 of the control unit 43 in such a way that a decrease of the liquid throughput is accompanied by a reduction of the supply of solid matter and vice versa. The desired value mentioned above for the volume to be delivered from the proportioning device 29 to the inlet hopper 13 or the corresponding quantity of solid matter is also set in the control unit 43.

Basically, it is also possible to operate the mixer 4 by underfeeding, i.e. less liquid 2 and less solid matter 38 is supplied to it than corresponds to its conveying capacity $V_{mixer}$. In this case $$V_{mixer} > F_{solid\ matter} + V_{mix}$$

applies, $V_{solid\ matter}$ and $V_{mix}$ meaning the volume flow of solid matter and the volume flow of the mix of solid matter and liquid. When the mixer 4 works in the manner described above by complete filling, then $$V_{mixer} = V_{solid\ matter} + V_{mix}$$

applies. In the latter case, in which $$V_{mixer} > V_{solid\ matter} + V_{mix}$$

applies, complete filling of the mixer 4 can be attained in that back-pressure is exercised on the mixer 4 by way of the return conduit 25. To this end, an adjustable throttle 51 with an associated manometer 52 is provided in the return conduit 25. The throttle 51 is connected to an output 53 of the control unit 43. In this case, with given high underfeeding of the mixer 4, the throttle 51 is controlled such that there is no deviation below the minimum level 44 and no deviation above the maximum level 45, the manometer 52 serving to monitor that there is no exceeding a maximally admissible pressure in the system.

Fundamentally, the adjustment is such that during an entire circulation of the liquid 2 located in the storage tank 1 through the mixer 4 and back into the storage tank 1, only a fraction of the solid matter 38 to be added to the liquid 2 is fed in. Depending on the kind of solid matter 38 and liquid 2 and the desired homogeneity, two to ten circulations of the liquid 2 can be adequate before the entire addition of the solid matter 38 is reached. When a finely dispersed mix is envisaged, even more than ten circulations can be necessary in many cases. In this connection, it must be added that the term liquid also comprises the mix of liquid 2 and solid matter 38 formed during the circulations. A pure liquid 2 is only available at the beginning of the process. It is—as mentioned—mixed with solid matter 38, forming a pourable mix of liquid and solid matter designated as liquid to simplify matters.

Whenever quantities of liquid are mentioned, these can be volumes as well as quantities in weight. The same applies to the solid matter 38.

The agitator unit 3 in the storage reservoir 1 serves to produce a balanced concentration in the storage tank 1, i.e. to provide for a uniform concentration of solid matter 38 in the liquid 1 within the entire storage tank 1.

Figure 2:
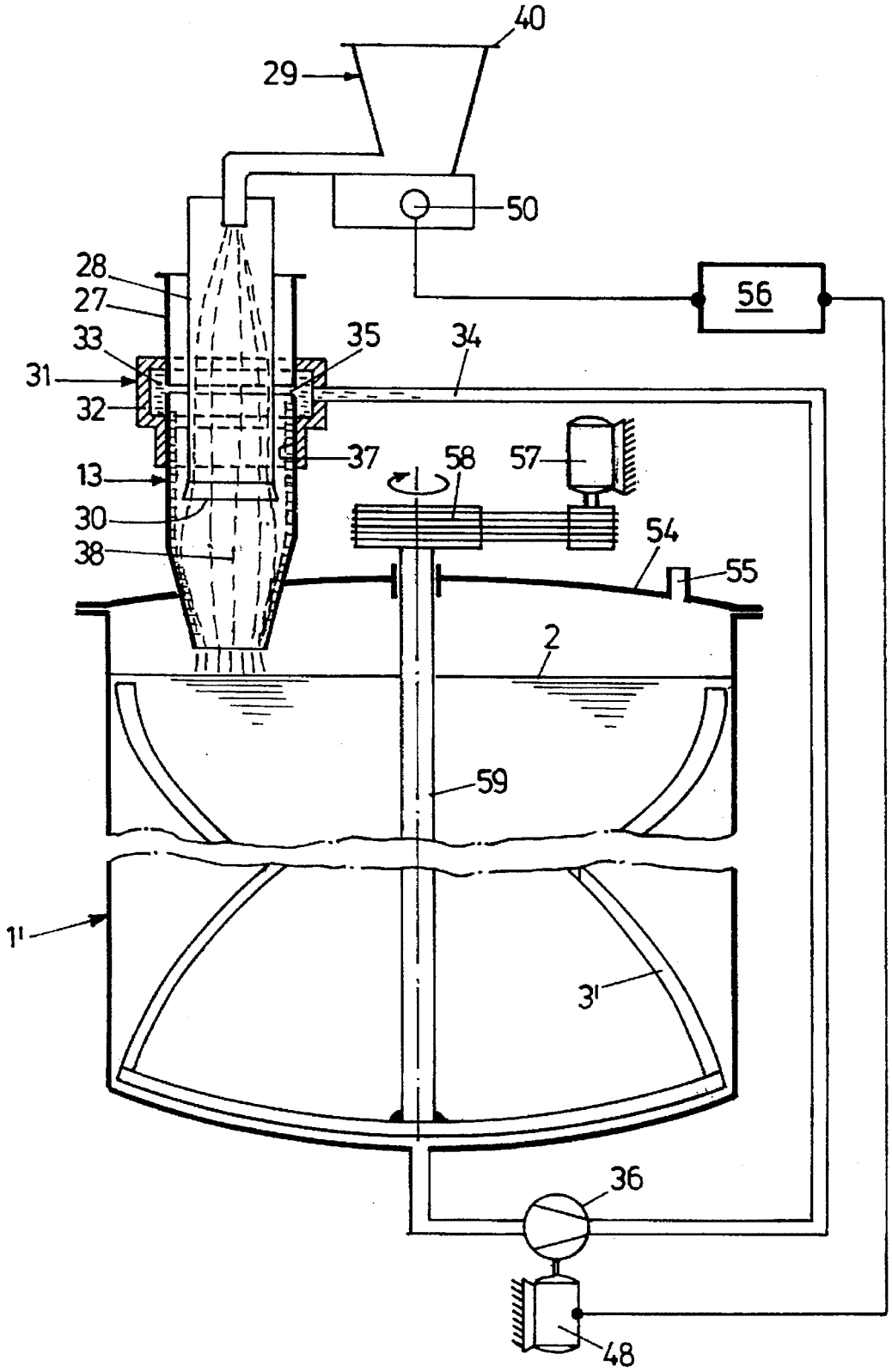
FIG. 2 shows another embodiment of an installation for the mixing of liquid with solid matter comprising a storage tank that serves as a mixing device and an inlet hopper which opens into the storage tank and has a liquid supply arrangement with an upstream solid matter proportioning device.

An eccentric screw pump or a commercial mixer provided with conveying devices may also be used as a mixing machine 4. Its automatic conveying is of substantial importance, i.e. it must confer a conveying impetus to the liquid 2 and the solid matter 38.

Where identical components are used in the embodiment according to FIG. 2, they have the same reference numerals as in FIG. 1. When components of identical function but differing in construction are used, they have the same reference numeral provided with a prime. Reference is made to the preceding description.

The embodiment according to FIG. 2 does not exhibit a mixing machine separated from the storage tank; rather, the storage tank 1' is provided with an intimately mixing agitator unit 3', which causes an intense recirculation of the liquid 2 in the storage tank 1'. Agitator units 3' of this kind are known; they are for instance so-called helical agitator units in particular exercising a pronounced feed-in effect on the liquid 2 in the vicinity of the latter's surface. The storage tank 1' is provided with a cover 54 having a vent 55, for instance for a pendulum ventilation system.

In the embodiment of FIG. 2, the inlet hopper 13 is mounted in the cover 54 and ends above the liquid 2. It is disposed sufficiently far above the liquid 2 so that even with the entire solid matter 38 mixed into the liquid 2, it will not dip into this mix.

Further, an operating unit 56 is provided, by means of which the conveying capacity of the pump 36 can be set by corresponding adjustment of the speed of the pump driving motor 48 on the one hand, and by means of which the proportioning capacity of the proportioning device 29 can be set on the other hand. This serves to fix that the contents of the storage tank 1' are recirculated several times while the solid matter 38 is added by the proportioning device 29 via the inlet hopper 13. With this embodiment, it is possible in particular to recirculate the liquid 2, or the mix of the liquid 2 and an increasing portion of solid matter 38, more than ten times before the entire quantitiy of solid matter 38 has been added. In this connection, the mixing of liquid 2 and solid matter 38 is performed exclusively in the storage tank 1' by means of the latter's agitator unit 3'; any dispersing does not take place. For many applications, however, the mixing performed is sufficiently good.

In the embodiment according to FIG. 2, an agitator unit driving motor 57 takes the function of a mixer driving motor which drives the agitator unit shaft 59, serving as a mixing shaft, of the agitator unit 3' by means of a V-belt drive 58. In the embodiment according to FIG. 2, the storage tank 1' comprising the agitator unit 3' does not only serve as a storage tank but also as a mixing device.

What is claimed is:

1. An installation for the mixing of a given quantity of liquid with a given quantity of powdery solid matter, comprising:

a storage tank (1,1') for the given quantity of liquid (2), a mixing device (4) having a mixing shaft (9, 59) drivable by a mixer driving motor (11, 57) and an inlet hopper (13) and an outlet, a liquid supply conduit (34) connecting the mixing device (4) with the storage tank (1) through the inlet hopper (13), the liquid supply conduit (34) opening by means of a liquid supply arrangement through the inlet hopper (13) into the mixing device (4), a solid matter proportioning device (29) opening into the inlet hopper (13) by means of a solid matter supply arrangement, and means for adjusting and controlling the supply capacity of the solid matter proportioning device (29) and the throughout of the mixing device (4) so that the given quantity of solid matter (38) is added to the given quantity of liquid (2) in several circulations of the liquid (2) through the mixing device (4).

2. An installation according to claim 1, wherein the mixing device is a mixing machine (4) separate from the storage tank (1), the outlet of which is connected with the storage tank (1) by a return conduit (25).

3. An installation according to claim 2, wherein the mixing machine is a screw mixer (4) having a mixing shaft (9), which comprises a screw portion (16) in the vicinity of the inlet hopper (13) and subsequent thereo.

4. An installation according to claim 2, wherein the mixing shaft (9) has a portion of intimate mixing (17) in the area upstream of the outlet.

5. An installation according to claim 4, wherein in the vicinity of the portion of intimate mixing (17), the mixing shaft (9) is provided with pins for mixing (18).

6. An installation according to claim 5, wherein in the vicinty of the portion of intimate mixing (17), the pins for mixing (18) are associated with stationary counterpart pins (20).

7. An installation according to claim 4, wherein in the vicinity of the portion of intimate mixing (17), the mix shaft (9) is provided with strips for mixing.

8. An installation according to claim 7, wherein in the vicinity of the portion of intimate mixing (17), the strips for mixing (18) are associated with stationary counterpart strips (20).

9. An installation according to claim 2, wherein in the vicinity of the outlet of the mixing machine (4), a return conveyor (22) is provided, which is connected with the return conduit (25).

10. An installation according to claim 9, wherein the return conveyor (22) comprises a pump impeller (23) mounted on the mixing shaft (9) and associated with an outlet passage (24), which is connected with the return conduit (25).

11. An installation according to claim 2, wherein a control unit (43) is provided, having outputs (46, 47) for the modification of at least one of the quantity of liquid (2) fed to the inlet hopper (13) per unit of time and of the quantity of liquid (2) put through per unit of time in the mixer (4).

12. An installation according to claim 11, wherein a level measuring device (41), which is connected to an input (42) of the control unit (43), is disposed in the inlet hopper (13).

13. An installation according to claim 11, wherein an output (49) of the control unit (43) is connected to a drive (50) of the solid matter proportioning device (29).

14. An installation according to claim 2, wherein an adjustable throttle (51) is disposed in the return conduit (25) to create a back pressure to maintain complete filling of the mixer (4).

15. An installation according to claim 14, wherein the throttle (51) is controllable.

16. An installation according to claim 1, wherein an intimately mixing agitator unit (3') exhibiting a pronounced feed-in effect is disposed in the storage tank (1').

17. An installation according to claim 1, wherein above the mixing device, the solid matter supply arrangement and the liquid supply conduit (34) open freely into the inlet hopper (13).

18. An installation according to claim 17, wherein the solid matter supply arrangement opens into the inlet hopper (13) within the liquid supply arrangement.

19. An installation according to claim 1, wherein the storage tank (1') is closed by a cover (54).

20. An installation according to claim 1, wherein an agitator unit (3, 3') is disposed in the storage tank (1, 1').

21. An installation according to claim 1, wherein the storage reservoir (1') is a mixing device, into which opens the inlet hopper (13).

* * * * *